United States Patent [19]

Stanley

[11] 4,166,233

[45] Aug. 28, 1979

[54] PHOSPHOR SCREEN FOR FLAT PANEL COLOR DISPLAY

[75] Inventor: Thomas O. Stanley, Princeton, N.J.

[73] Assignee: RCA Corporation, New York, N.Y.

[21] Appl. No.: 806,281

[22] Filed: Jun. 13, 1977

[51] Int. Cl.[2] ..... H01J 29/32

[52] U.S. Cl. ..... 313/422; 315/366

[58] Field of Search ..... 313/422, 472, 470, 471

[56] References Cited

U.S. PATENT DOCUMENTS

| | | | |
|---|---|---|---|
| 2,802,964 | 8/1957 | Jesty | 313/472 |
| 3,614,504 | 10/1971 | Kaplan | 313/472 |
| 3,904,923 | 9/1975 | Schwartz | 315/169 TV |
| 4,069,439 | 1/1978 | Anderson | 313/422 |

*Primary Examiner*—Robert Segal

*Attorney, Agent, or Firm*—Eugene M. Whitacre; Donald S. Cohen; Vincent J. Coughlin, Jr.

[57] ABSTRACT

Across the screen is a mosaic of phosphor bodies which will emit light of different colors when excited by electrons. Phosphors which will emit three different colors, e.g. red, green and blue, are used and are disposed in a regular repetitive array of groups of three, i.e. triads. In every other triad the phosphor body which emits the color which has the least acuity to the eye, e.g. blue, is replaced by a nonluminescent black material. This black material is used to hide the edges of a support wall which extends to the screen.

7 Claims, 2 Drawing Figures

PHOSPHOR SCREEN FOR FLAT PANEL COLOR DISPLAY

BACKGROUND OF THE INVENTION

The present invention relates to flat panel color displays having internal envelope support members and particularly to such a screen in which the color emitting phosphors are arranged to provide additional room for concealing the contact area between the internal support members and the screen.

There has been developed a flat panel display which includes an evacuated envelope having spaced, parallel, substantially flat front and back walls and a plurality of spaced, substantially parallel support walls extending between and substantially perpendicular to the front and back walls. One function of the support walls is to provide internal support for the front and back walls against the external atmospheric pressure. The display includes means for generating electrons and directing beams of the electrons against a phosphor screen on the inner surface of the front wall to achieve a visual display. One type of flat panel display which includes such a structure is shown and described in U.S. Pat. No. 4,001,620 to John G. Endriz, issued Jan. 4, 1977, entitled "Modulation Mask For An Image Display Device," and in the copending application for Letters Patent of John G. Endriz et al, Ser. No. 672,122, filed Mar. 31, 1976, entitled "Parallel Vane Structure For A Flat Display Device." Another type of flat panel display which uses such a construction is shown and described in the copending application for Letters Patent of Thomas O. Stanley, Ser. No. 607,492, filed Aug. 25, 1975, entitled "Flat Electron Beam Addressed Device," now U.S. Pat. No. 4,031,427, issued June 21, 1977.

In general, a phosphor screen for a color display includes a mosaic of phosphor bodies which when excited by electrons emit light of different colors, e.g. red, green and blue, arranged across the screen in a regular repetitive array. The phosphor bodies may, for example be circular areas of the phosphors or parallel stripes of the phosphors. A problem with the display devices of the above-identified construction is that the contact between the support walls and the front wall provides interruptions in the phosphor screen which can interfere with the visual display, e.g. provide undesirable visible lines across the display. Therefore, it would be desirable to have a phosphor pattern for a color display which would hide the support walls yet not interfere with the appearance of the visual display, i.e. without decreasing the resolution of the display.

SUMMARY OF THE INVENTION

A flat display device includes an evacuated envelope having a plurality of internal supports which extend to a screen bearing wall. The screen includes repetitive groups of different color emitting phosphor bodies. A selected one of the same color emitting bodies in some of the phosphor is replaced with a nonluminous body, e.g. a black material body. Each of the supports is positioned at a separate one of the nonluminous material bodies.

Detailed Description of the Invention

Figure 1:
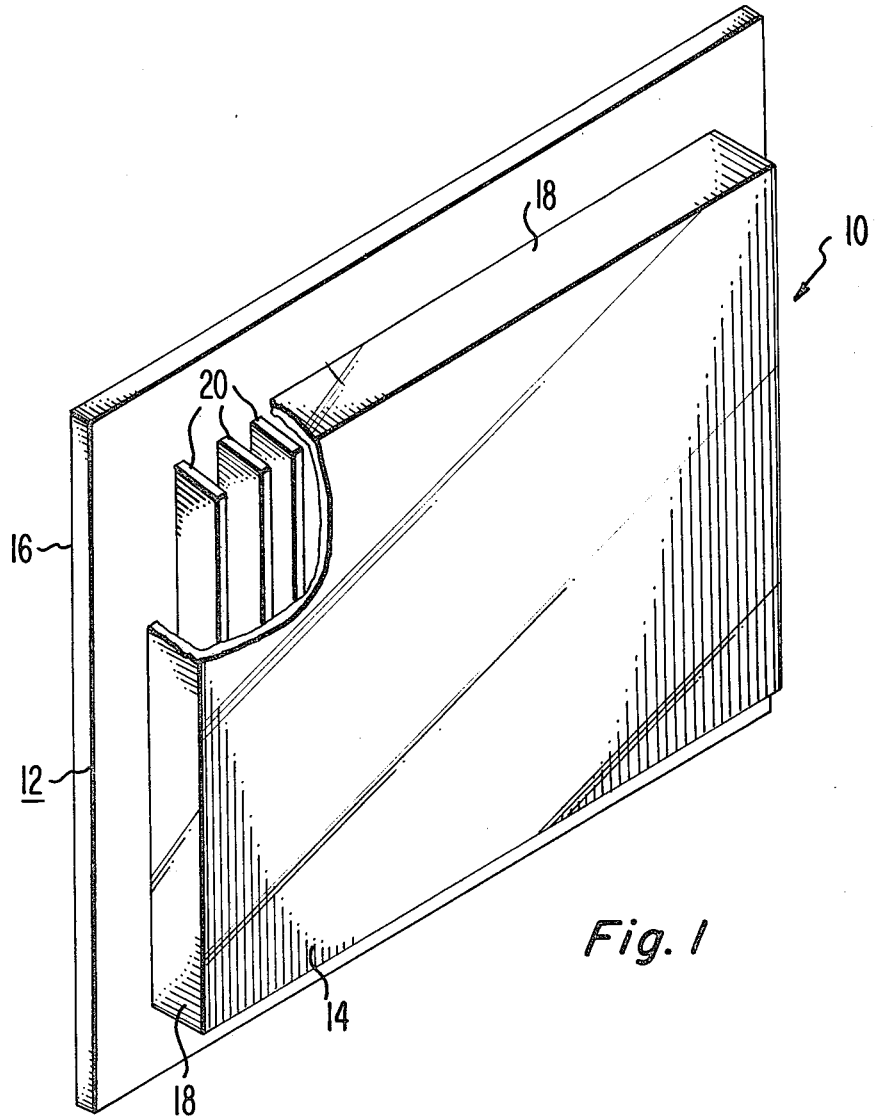
FIG 1 is a perspective view, partially broken away of a form of a flat panel display which can include the phosphor screen of the present invention.

Referring to FIG. 1, one form of a flat display device of the present invention is generally designated as 10. The display device 10 comprises an evacuated envelope 12, typically of glass, having a substantially flat rectangular front wall 14 and a substantially flat rectangular back wall 16 in spaced, parallel relation with the front wall 14. The front wall 14 and back wall 16 are connected by side walls 18. The front wall 14 is dimensioned to provide the size of the viewing screen desired, e.g. 75×100 centimeters and is spaced from the back wall 16 about 2.5 to 10 centimeters. A plurality of spaced, parallel support walls 20 are secured between and are substantially perpendicular to the front wall 14 and the back wall 16. The support walls 20 provide the desired internal support for the evacuated envelope 12 against external atmospheric pressure.

Figure 2:
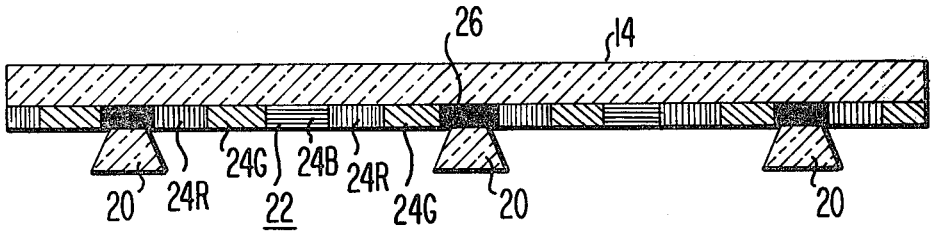
FIG. 2 is a sectional view across a portion of the front wall showing a form of the phosphor screen of the present invention.

On the inner surface of the front wall 14 is a phosphor screen 22. As shown in FIG. 2, the phosphor screen 22 includes a plurality of bodies 24R, 24G and 24B of phosphors which emit light of different colors when excited by electrons. The phosphor bodies 24R will emit red light, the phosphor bodies 26G will emit green light and the phosphor bodies 24B will emit blue light. The phosphor bodies 24R, 24G and 24B may be parallel stripes of the phosphor material extending parallel to the support walls 20 or may be circular or other shaped bodies extending in rows transversely of or parallel to the support walls 20. The phosphor bodies are arranged in a mosaic of groups with each group containing one of each color emitting phosphor body 24R, 24G and 24B and with the bodies being arranged in the same sequence in each group. However, periodically, preferably in every other group, one of the color phosphor bodies is left out. The color phosphor body that is left out is the one that to the eye has the least acuity, which in the case of red, green and blue is the blue phosphor body 24B. The area of the screen 22 which would normally be covered by the blue-emitting phosphor body 24B which is left out is covered instead by a body 26 of a nonluminescent black material. The blue phosphor bodies 24B and the black material bodies 26 are preferably of the same width transversely of the support walls 20. The red and green phosphor bodies 24R and 24G may be of the same width as the blue phosphor bodies 24B or may be different, preferably narrower than the blue phosphor bodies.

As shown in FIG. 2, the support walls 20 are positioned at the black bodies 26. It is not necessary to have a support wall 20 at each of the black bodies 26 as shown in FIG. 2 as long as the support walls 20 are spaced apart such that each support wall is at a black body 26.

Within the envelope 12 is means for generating electrons and directing beams of the electrons toward the phosphor screen 22. One type of beam generating means which can be used is shown and described in the previously referred to U.S. Pat. No. 4,001,620 and the application of J. G. Endriz et al, Ser. No. 672,122. This type of beam generating means includes a cathode on the inner surface of the black wall 16 and an ion feedback multiplier between the cathode and the front wall 14. The ion feedback multiplier includes a series of multiplier dynodes for multiplying the electrons emitted from the cathode, and a gas which will be ionized by the electrons with the ions being fed back to impinge on the cathode and generate additional electrons. The electrons can be formed into beams each of which is directed toward a separate phosphor stripe of the screen 22 either by a metal sheet having slots therein which permit the electrons to flow therethrough as shown in U.S. Pat. No. 4,001,620 or by forming the cathode as individual parallel strips which extend transversely across the channels between the support walls 20 as shown in application Ser. No. 672,122. At each point where a cathode strip crosses a channel a beam of electrons will be generated.

Another type of beam generating means which can be used is shown and described in the previously referred to application, Ser. No. 607,492, now U.S. Pat. No. 4,031,427 issued June 21, 1977. This type of beam generating means includes a gun structure along one of the side walls 18 which extends across one end of each of the channels formed between the support walls 20. The gun structure is adapted to generate electrons, such as from one or more cathodes, and direct the electrons into each of the channels in the form of one or more beams. Along each of the channels is a beam guide for each beam. Each beam guide is adapted to confine the electrons to the beam as the beam flows along the channel. The beam guides also include means for selectively extracting the beams and directing them toward the front wall 14 at a plurality of spaced points along the channels. The beams impinge on the phosphor stripes 24R, 24G and 24B to achieve line scans of the phosphor screen 22. The display device may include one electron beam for each transverse phosphor body or, each beam may be deflected across the phosphor screen 22 so as to impinge on several phosphor bodies.

No matter which of the above described types of electron beam forming and directing structure is used, the phosphor screen is scanned by the beams line-by-line transversely across the channels between the support walls 20. All of the phosphor bodies 24R, 24G and 24B in each transverse line scan may be scanned by the electron beams simultaneously or in some type of sequence. This excites the phosphor bodies to provide a visual display. The uniform pattern arrangement of the phosphor bodies provides the desired color display. Although a blue emitting phosphor body 24B is periodically missing, it will not be objectionable to the eye since blue has the least acuity to the eye. However, in order to retain color balance it is necessary that the luminous intensity of the remaining blue emitting phosphor bodies 24B be increased, preferably doubled, over what would be their normal width. This can be achieved either by doubling the normal intensity of the electron beams which impinge on the blue phosphor bodies or by having more than one electron beam impinge on each of the blue phosphor bodies. In addition, having the black material bodies 26 of the same size as the blue phosphor bodies 26B assists in achieving a similarity between the two bodies. Thus, the low acuity to the eye of blue and its replacement by something similar to the eye and of the same size provide an uninterrupted appearance to the visual display even though a blue phosphor stripe is periodically missing. However, by replacing the blue phosphor stripe 24B with a black material body 26 there is provided a body in which a support wall 20 can be placed. Thus, the contact areas between the support walls 20 and the front wall 14 are hidden from view without disrupting the visual appearance of the display provided by the phosphor screen 20.

Thus, there is provided a phosphor screen for a flat panel color display in which the different color-emitting phosphor bodies are arranged so as to periodically provide bodies of a black material which are sufficiently wide so as to hide the edges of the support walls which extend to the front wall. However, the phosphor bodies are arranged so that the black bodies do not appear to the eye to interrupt the appearance of the visual display provided by the screen. In the display device 10, the support walls 20 may be replaced by a plurality of support posts which are positioned at the black bodies 26. Also, although the screen has been described as being made of groups of triads of red, green and blue emitting phosphor bodies, the groups can be made up of any well known combination of color emitting phosphor bodies with the color having the least acuity to the eye being periodically replaced with the black material body.

I claim:

1. A flat display device comprising an evacuated envelope having a plurality of spaced supports which contact a screen bearing wall of the envelope, said screen including a mosaic of repetitive groups of different color emitting phosphor bodies with a selective one of the same color emitting phosphor bodies of some of the groups being replaced by a body of a nonluminous material, each of the supports being positioned at a separate nonluminous material body.

2. A flat display device in accordance with claim 1 in which the nonluminous material is a black material.

3. A flat display device in accordance with claim 2 in which the color emitting phosphor body which is periodically replaced by the black material is the color which has the least acuity to the eye.

4. A flat display device in accordance with claim 3 in which the color emitting phosphor bodies in each group are red, blue and green emitting phosphors and the color which is periodically replaced by the black nonluminous material is the blue emitting phosphor.

5. A flat display device in accordance with claim 4 in which each of the blue emitting phosphor bodies and the black material bodies are of the same width.

6. A flat display device in accordance with claim 5 in which the blue emitting phosphor bodies and the black bodies are of a different width from that of the red and green emitting phosphor bodies.

7. A flat display device in accordance with claim 6 in which the blue emitting phosphor bodies and the black bodies are wider than the red and green emitting phosphor bodies.

* * * * *